US006903503B2

(12) United States Patent
Ha

(10) Patent No.: US 6,903,503 B2
(45) Date of Patent: Jun. 7, 2005

(54) FLAT NEON SIGN DEVICE USING FLAT ELECTRODE AND LOWER PLATE STRUCTURE

(75) Inventor: Hong-Ju Ha, Kyunggi-Do (KR)

(73) Assignee: Grand Display, Inc., Kyunggi-Do (KR)

( * ) Notice: Subject to any disclaimer, the term of this patent is extended or adjusted under 35 U.S.C. 154(b) by 100 days.

(21) Appl. No.: 10/344,403

(22) PCT Filed: Aug. 20, 2001

(86) PCT No.: PCT/KR01/01405

§ 371 (c)(1),
(2), (4) Date: Jul. 21, 2003

(87) PCT Pub. No.: WO02/101697

PCT Pub. Date: Dec. 19, 2002

(65) Prior Publication Data

US 2004/0003524 A1 Jan. 8, 2004

(30) Foreign Application Priority Data

Jun. 12, 2001 (KR) ..... 2001-32973

(51) Int. Cl.[7] ..... H01J 1/62
(52) U.S. Cl. ..... 313/485; 313/493; 313/634
(58) Field of Search ..... 313/485, 493, 313/515, 634, 635

(56) References Cited

U.S. PATENT DOCUMENTS 3,838,307 A * 9/1974 Masi ..... 313/486
5,617,659 A 4/1997 Okubo
5,717,284 A * 2/1998 Anandan et al. ..... 313/493

FOREIGN PATENT DOCUMENTS

KR 2001-70838 A 7/2001

* cited by examiner

*Primary Examiner*—Vip Patel
(74) *Attorney, Agent, or Firm*—Bacon & Thomas

(57) ABSTRACT

Disclosed are a neon light utilizing a flat plate electrode and a lower plate structure employed in the neon light. In the neon light, an advertisement pattern is expressed by means of discharge spaces formed by carving out one or both of two insulation plates, the upper and lower plates. Therefore, the discharge spaces are integrally formed at the upper plate and/or the lower plate. Further, the electrodes for the electric discharge, which are formed at the upper and lower electrodes, utilize flat plate electrodes. The phosphor elements in the discharge space are excited, so as to emit visible rays to the exterior. Therefore, the present invention decreases the discharge voltage and increases the brightness, while facilitating the manufacture of the neon light.

21 Claims, 5 Drawing Sheets

FLAT NEON SIGN DEVICE USING FLAT ELECTRODE AND LOWER PLATE STRUCTURE

TECHNICAL FIELD

The present invention relates to a neon light utilizing a flat plate electrode and a lower plate structure employed in the neon light.

BACKGROUND ART

In general, a neon light is a lighting apparatus, which can be used for displaying characters and figures for advertising (hereinafter, referred to as an "advertisement pattern", which includes all kinds of designs such as characters and logograms).

Further, existing neon lights usually utilize a linear light source.

In such a neon light utilizing a linear light source as described above, in the case where an advertisement pattern to be displayed has a linear shape, an electrode is formed along the advertisement pattern. In contrast, where the advertisement pattern to be displayed has a predetermined geometrical shape, the electrode is formed along the rim of the advertisement pattern. Further, high voltage is applied to the electrode, so as to induce an electric discharge. As a result, the electric discharge is generated at a portion, near which the electrode is formed, so that the rim of the advertisement pattern to be displayed is lit according to the colors of the phosphor elements in the advertisement pattern.

In the conventional neon light utilizing a linear light source as described above, since only the rim of the advertisement pattern is lit when the advertisement pattern is displayed, it is difficult to display the exact advertisement pattern a user wants to display. Moreover, when a portion of the electrode fails to generate electric discharge, the displayed advertisement pattern cannot have the desired shape.

Further, in the case of the neon light utilizing a linear light source, since the electrode is formed along the rim of the advertisement pattern to be displayed, the displayed advertisement pattern can have a desired pattern only when the electric discharge is generated over the entire electrode.

In order to enable the electric discharge to generate over the entire electrode, the shortest possible discharge path has to be arranged between electrodes having different polarities, which are formed along the rim of the advertisement pattern. This is because the neon gas, which generates electric discharge to display the advertisement pattern, has a tendency to generate electric discharge along the shortest discharge path between electrodes having different polarities. Therefore, in order to induce electric discharge over the entire advertisement pattern, the electrodes formed at the rim of the advertisement pattern have to be divided, so as to arrange a plurality of discharge paths, which are the shortest discharge paths.

In conventional neon lights as described above, the rim of the advertisement pattern has to be divided so as to form different discharge paths, in which electric discharge is induced. Such division not only makes the construction of the electrodes complicated, but also requires very high electric discharge voltage and limits the shape of the advertisement patterns which can be displayed.

That is, since the conventional neon light is a neon light utilizing a linear light source, the kinds of advertisement patterns which can be displayed by the conventional neon light are limited and the manufacturing cost of the conventional neon light is relatively high.

In consideration of these problems, the present invention is aimed at utilizing a surface light source, in which light is generated along the entire surface of the surface light source, in a neon light.

In the surface light source, light is emitted from the entire surface, which constitutes the light source. Therefore, in the case of a surface light source, a surface shadow or a cast shadow faintly appears as it is difficult to see the shadow, and there is little distortion of colors. That is, the surface light source uniformly illuminates the entire object, has little distortion of colors, and feels bright on the whole. Therefore, by utilizing the surface light source, a more efficient neon light can be obtained.

DISCLOSURE OF THE INVENTION

Therefore, the present invention has been made in view of the above-mentioned problems, and it is an object of the present invention to provide a neon light utilizing a flat plate electrode and a lower plate structure employed in the neon light, which can display an advertisement pattern by means of a surface light source.

According to an aspect of the present invention, there is provided a neon light utilizing a flat plate electrode, the neon light comprising: a first plate having at least a discharge space and a first flat plate electrode, the discharge space being formed by carving out a first surface of the first plate according to an advertisement pattern, the first flat plate electrode being received in the discharge space so as to generate electric discharge; and a second plate having a second flat plate electrode for inducing the electric discharge, the second plate being tightly attached to the first surface of the first plate, on which the advertisement pattern is formed.

It is preferred that the second plate has a shape equal to a shape of the first plate. That is, a discharge space is formed in the second plate also, likewise in the first plate.

At least one of the first plate and the second plate is made from transparent material.

At least one of the first flat plate electrode and the second flat plate electrode is made from transparent material.

A phosphor element is applied inside of the discharge space.

Otherwise, a phosphor element is applied on a portion of a surface of the second plate, which corresponds to the discharge space.

The first flat plate electrode is formed on an external surface of the first plate or inside of the discharge space.

The neon light may further comprise an insulation layer formed on the first flat plate electrode.

The first flat plate electrode is formed correspondingly to an area of the discharge space of the first plate.

At least one of the first flat plate electrode and the second flat plate electrode is made from indium tin oxide.

The first flat plate electrode, which is on the external surface of the first plate, is formed correspondingly to an entire area of the first plate.

The second flat plate electrode is formed on an external surface of the second plate. Also, a protector layer is formed on a lower surface of the second plate.

Otherwise, the second flat plate electrode is formed on an internal surface of the second plate. Further, an insulation layer is formed on a lower surface of the second plate, and a protector layer is formed on a lower surface of the insulation layer.

According to an aspect of the present invention, there is provided a lower plate structure employed in a neon light utilizing a flat plate electrode, the lower plate structure comprising: a lower glass having at least a discharge space, which is formed by carving out one surface of the lower glass according to an advertisement pattern to be displayed; a flat plate electrode formed on a first surface and a second surface of the lower glass so as to induce electric discharge, the advertisement pattern being formed on the first surface, the second surface corresponding to the first surface; and at least a phosphor element formed in the discharge space.

In the lower plate structure, the flat plate electrode is formed only on a portion corresponding an area of the advertisement pattern.

Otherwise, the flat plate electrode is formed on an entire area of the lower glass.

According to an aspect of the present invention, there is provided a lower plate structure employed in a neon light utilizing a flat plate electrode, the lower plate structure comprising: a lower glass having at least a discharge space, which is formed by carving out an upper surface of the lower glass according to an advertisement pattern to be displayed; a flat plate electrode so formed as to induce electric discharge in the discharge space; an insulation layer formed on the flat plate electrode; and at least a phosphor element formed on the insulation layer.

That is, the lower plate structure employed in a neon light utilizing a flat plate electrode according to the present invention represents the structure of a substrate of one side in the neon light, which has at least a discharge space, which is formed by carving out one surface of the lower glass according to an advertisement pattern to be displayed. Therefore, even when the lower plate structure described in the present invention may be employed in the upper plate, it goes without saying that the same effect is provided.

BRIEF DESCRIPTION OF THE DRAWINGS

The foregoing and other objects, features and advantages of the present invention will become more apparent from the following detailed description when taken in conjunction with the accompanying drawings in which.

BEST MODE FOR CARRYING OUT THE INVENTION

Hereinafter, a neon light utilizing flat plate electrodes according to a preferred embodiment of the present invention will be described in detail with reference to the accompanying drawings.

Figure 1:
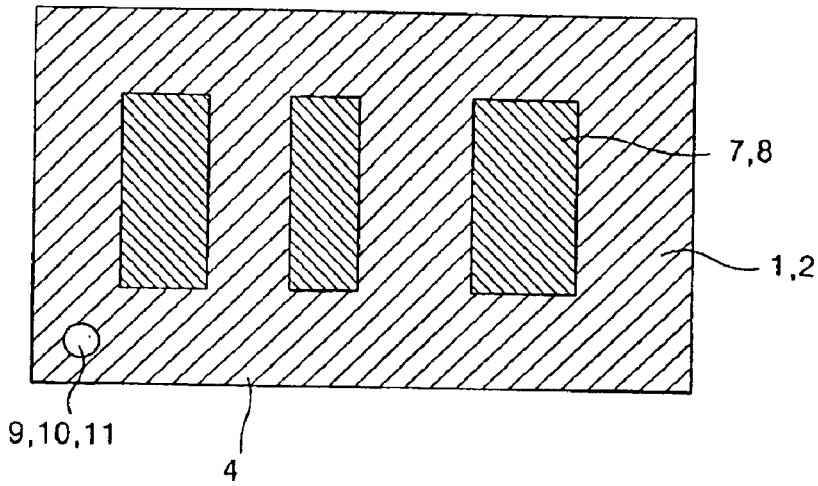
FIG. 1 is a plan view of a neon light utilizing a flat plate electrode according to the present invention.

FIG. 1 is a plan view of a neon light utilizing a flat plate electrode according to the present invention, which shows three rectangles of different sizes employed as an advertisement pattern in a neon light.

Figure 2A:
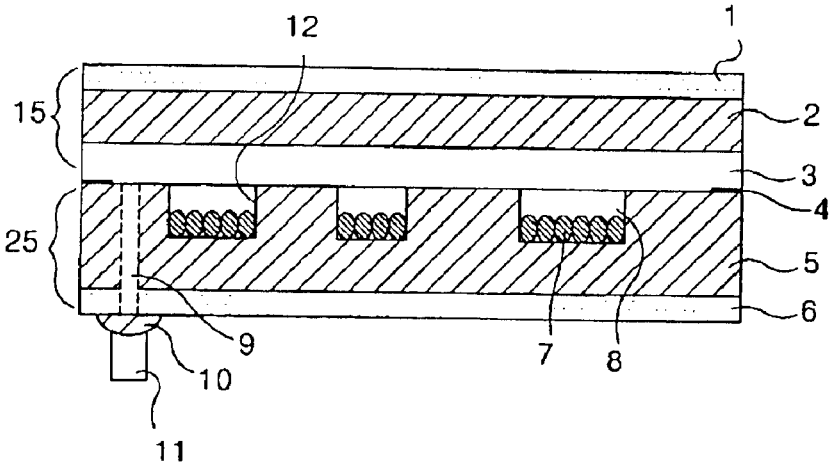
FIG. 2*a* is a sectional view of a neon light according to the first embodiment of the present invention.
Figure 2B:
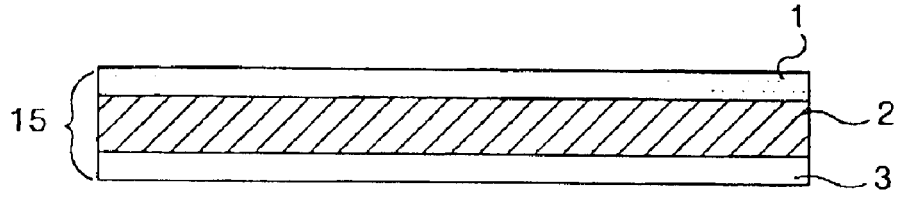
FIG. 2*b* is a sectional view of an upper plate employed in the neon light according to the first embodiment of the present invention.
Figure 2C:
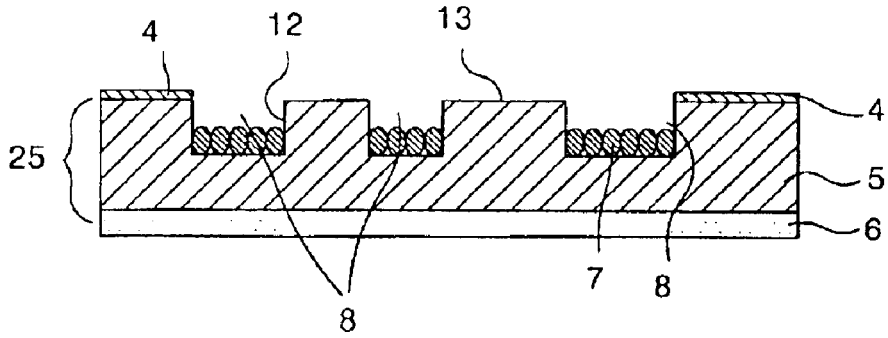
FIG. 2*c* is a sectional view of a lower plate employed in the neon light according to the first embodiment of the present invention.

FIGS. 2*a* to 2*c* are sectional views of a neon light utilizing a flat plate electrode according to the first embodiment of the present invention.

FIG. 2*a* shows a neon light utilizing a flat plate electrode according to the first embodiment of the present invention, in which an upper plate 15 and a lower plate 25 are attached to each other by means of a first sealant 4. Therefore, the upper plate 15 and the lower plate 25 are separately constructed before they are attached to each other by means of a first sealant 4 as described above. Further, after the upper plate 15 and the lower plate 25 are completely provided with necessary construction, the upper plate 15 and the lower plate 25 are sealed together, so that a complete neon light utilizing a flat plate electrode is produced.

In the following description of the present invention, the constructions of the upper and lower plates in the present embodiment as shown are those employed only in consideration of convenience of description, and instead the upper and lower plates may have reverse constructions to those described above. Further, the upper plate may employ the same construction as that of the lower plate in the present embodiment.

One characteristic of a neon light having the construction as described above according to the present invention is that a lower surface of the upper plate 15 and an upper surface of the lower plate 25 are completely attached to each other. Therefore, discharge spaces 8, which have to be arranged between the upper plate 15 and the lower plate 25, are cavities formed by partially carving out the upper surface of a lower substrate.

Accordingly, a separate member for defining a discharge space between the upper plate 15 and the lower plate 25 is not necessary. For example, it is not necessary to place a spacer or a member having a ball shape between the upper plate 15 and the lower plate 25. Therefore, the upper plate 15 and the lower plate 25 can be sealed together in a simple and easy manner only by applying sealing solution on only one of the two attached surfaces of the two plates and then tightly attaching the two plates.

Moreover, the present invention is also characterized in that the electrodes provided at the upper and lower plates 15 and 25 so as to generate electric discharge are respectively a flat plate electrode. That is, the electrode is formed over the entire surface of a supporting substrate or over an entire portion on which an advertisement pattern is formed, so that the neon light has a substantially infinite electrode.

Since the flat plate electrode emits light from the entire advertisement pattern or the entire surface of the neon light according to the present invention, it can function as a brighter and clearer light source.

Further, in the neon light of the present invention, the discharge space is required to be so formed as to have a shape equal or similar to that of an advertisement pattern to be displayed. That is, the neon light has such a construction as that the electric discharge is generated only in the advertisement pattern to be displayed, so as to improve discharge efficiency and moreover induce a clear difference between portions, in which discharge is generated, and the other portions, in which discharge is not generated.

Hereinafter, the construction of the neon light utilizing a flat plate electrode according to the first embodiment of the present invention will be described according to a process of manufacturing the neon light.

The upper plate 15 shown in FIG. 2*b* has an upper electrode 1 formed at the uppermost location thereof. Further, an upper substrate 2 is disposed under the upper electrode 1, and a protector layer 3 is disposed under the upper substrate 2.

The upper electrode 1 has a form of a flat plate electrode extending over the entire upper surface of the upper substrate 2. Since the upper electrode 1 is formed on the upper substrate 2, it is possible to form the upper electrode in the final stage after the upper plate 15 and the lower plate 25 are sealed together.

Moreover, the protector layer 3 is formed over the entire lower surface of the upper substrate 2.

Therefore, since the upper electrode 1 and the protector layer 3 are formed over the entire upper and lower surfaces of the upper substrate 2 respectively, they can be formed without such an apparatus as a pattern mask. Therefore, it is noted that the formation of an electrode can be carried out in a simple and easy mariner.

The lower plate 25 shown in FIG. 2*c* includes a lower substrate 5 and a lower electrode 6 attached to a lower surface of the lower electrode 6.

Portions of a flat upper surface 13 of the lower substrate 5 are carved out, so that the cavities 12 for the electric discharge are formed. That is, the cavities 12 are formed by eliminating portions of the upper surface 13 of the lower substrate 5 corresponding to the cavities 12. In the neon light of the present invention, the cavities 12 function as discharge spaces. The cavities for electric discharge are portions for forming predetermined discharge spaces between the upper plate 15 and the lower plate 25 when they are attached to each other. Therefore, the cavities 12 for the electric discharge have the same constructions as those of the advertisement patterns such as characters and designs to be substantially advertised by means of the neon light. For example, the cavities 12 may have three different rectangular shapes as shown in FIG. 1.

Further, phosphor elements 7 are applied to the inner surfaces of the cavities 12. The phosphor elements 7 have such effects as light scattering and light reflex in addition to the illumination by the electric discharge, so as to display advertisement patterns such as characters and figures, which are very clear and have high color contrast.

The upper substrate 2 and the lower substrate 5 function to support the upper plate 15 and the lower plate 25.

The insulation material used as the upper and lower substrates may be plastic material or ceramic material such as glass and alumina. Both or one of the upper and lower substrates may be made from transparent material. Also, one substrate disposed at the viewable side may be made from transparent material, while the other substrate disposed at the other side may be made from material having a high reflectivity such as a mirror.

It is preferred that the substrates are in the shape of a flat plate and that there is no gap or a gap, which is usually several hundreds micrometers and not larger than one millimeter, between the two substrates when they are attached to each other. That is, it is preferred that the substrates are made from material having a high flatness or are mechanically processed to have increased surface flatness.

The gap as described above means an interval between the upper and lower substrates opposed to each other, except for the space due to the cavities between the two substrates. Usually, the cavities are so formed as to respectively have a size between several hundred micrometers and several millimeters. Therefore, the cavities respectively have a size which is between several tens times and several thousands times the gap between the two substrates.

Further, each of the substrates preferably must have a high insulation strength, so that its insulation strength is not damaged even when high voltage is applied thereto. That is, the material for the substrates preferably has to have a high density, so that gas or other alien material is not discharged from the material through electric discharge, temperature increase, or vacuum evacuation. Further, the material must have very low capability of adsorbing gas or air when discharge gas is injected.

Especially, in the case of insulation material optically used as a front substrate, it has to have a high transmittance for visible rays. Further, it is preferred that the substrate has uniform transmittance and uniform refractivity, so that the inner optical path is not distorted and birefringence is not generated.

Also, it is preferred that the substrate is made from material which has a high capability of absorbing ultraviolet rays or electron rays so as not to emit light detrimental to the human body. The material for the substrate preferably has a coefficient of thermal expansion, which is as nearer to that of the sealant material as possible. Most preferably, the difference between the thermal expansive coefficients of the substrate material and the sealant material is not larger than ten percent of each coefficient.

Meanwhile, the upper electrode 1 and the lower electrode 6 function as discharge electrodes in the upper plate 15 and the lower plate 25.

The upper electrode 1 is formed on the outer surface of the upper substrate 2, and the lower electrode 6 is formed on the outer surface of the lower substrate 5. Therefore, the electrodes are formed outside of the cavities 12 which are discharging spaces. The electrodes may be formed by uniformly applying electrically conductive material over the entire surfaces, or insulation substrates with conductive material applied thereon may be employed.

As the electrically conductive material, the electrodes of the present invention may employ most metal conductors such as aluminum, copper, silver, and gold, or organic conductors such as conductive polymer.

The electrodes may be formed by means of various deposition methods utilizing low-pressure atmosphere or vacuum atmosphere such as sputtering and vacuum deposition, and may be formed by utilizing dipping, spraying, or various printing processes. Moreover, in order to increase the adhesive force of the electrodes, various optical, thermal, and chemical methods may be utilized.

Light generated due to the discharging operation by the electrodes may be emitted through the upper plate 15 or the lower plate 25, or may be emitted from both of the upper and lower plates if necessary. That is, the neon light has a surface light source on one side when light is emitted through one plate, while the neon light has surface light sources of two sides when the light is emitted through both two plates. In both cases, the substrate at the side emitting light has to be made from transparent material or semitransparent material, and the electrodes also have to be made from transparent material or semitransparent material.

As the electrode at the side emitting light, transparent conductors such as zinc oxide ZnO, tin oxide $SnO_2$, indium oxide $In_2O_3$, and indium tin oxide (ITO) are employed.

Since the transparent conductor has high electric resistance in comparison with materials having high conductivity such as silver, gold, and copper, and it is difficult for an external electrode to come into direct contact with the transparent conductor, an additional electrode for receiving electric power may be formed in or around the transparent conductor. The electrode for receiving electric power may be formed by means of conductive paste such as silver paste and carbon paste.

In the meantime, the discharge spaces 8 formed as the cavities 12 on the upper surface of the lower substrate 5 is completely isolated from the external atmosphere so as to secure independent physical (electrical) spaces, when the upper plate 15 and the lower plate 25 have been permanently attached to each other by means of the first sealant 4 which is a medium for sealing the upper plate 15 and the lower plate 25 together.

Desired colors of the neon light are expressed by means of self light emission of the discharge gas or phosphor elements 7 applied in advance on one or both of inner surfaces of the discharge spaces 8 and a surface of the other substrate opposed to the inner surfaces. When the light emission of the discharge gas by itself is utilized in expressing desired colors, it is not necessary to apply the phosphor elements 7.

The phosphor elements 7 are applied onto bottoms of the discharge spaces, which are formed by carving out a surface of a substrate by a predetermined depth through mechanical or chemical method, by means of various methods such as spraying, printing, and exposure. In this case, in order to increase the adhesive force, resin or solvent may be added.

The natural surface of the substrate made from insulation material may be utilized as the protector layer 3 or materials such as MgO, AlN, $Al_2O_3$, $TiO_2$, and $SiO_2$, which are useful in discharging electricity, may be coated on the substrate to form the protector layer 3. The above-mentioned materials function to protect the insulation material from the electric discharge and to increase the electron emission coefficient so as to improve the discharge efficiency. Further, the materials function to intercept gas emitted from organic material of plastic kind or to intercept materials, such as various ions, remaining gas, lead Pb, deposited metal and oxide, emitted into the discharge space from the insulation material.

The upper plate 15 and the lower plate 25, which are fabricated through the entire process for manufacturing a neon light utilizing a flat plate electrode as described above, are permanently attached to each other by means of sealant 4 which is a medium for attaching the upper and lower plates to each other.

Resin such as low-melting-point glass, bonding metal including kovar, and epoxy may be utilized as the medium for attaching the upper and lower plates, or the upper and lower plates may be attached to each other by means of electrostatic welding, ultrasonic fusion welding, or laser fusion welding, which utilize melting characteristics of the medium itself.

Through the above attachment process, a neon light utilizing a flat plate electrode as shown in FIG. 2*a* is completely manufactured.

In this case, the discharge spaces 8 are completely isolated from the atmosphere. Therefore, after air in the spaces is exhausted by means of such an apparatus as a vacuum apparatus, discharge gas such as argon and xenon is injected into the spaces, so that the consequent process for manufacturing the neon light is completed.

The air in the discharge spaces 8 is exhausted through an exhaust port 9 and an exhaust tube 11, and the discharge gas is injected also through the exhaust port 9 and the exhaust tube 11, which are then sealed by a second sealant 10 for attaching the exhaust tube. In this case, the exhaust port 9 is connected with the discharge space 8, so as to enable the air in the discharge space 8 to be exhausted and the discharge gas to be injected through the exhaust port 9.

The discharge gas must have suitable pressure and composition, by which the discharge voltage can be lowered and the discharge efficiency can be increased. Therefore, binary, ternary, or quaternary gas mixture rather than a single gas is used. Such gases as argon, neon, and helium are generally used as a buffer gas for maintaining the entire pressure, and xenon is utilized in discharging ultraviolet rays. Especially, when the light emitted from the gas itself is utilized, neon gas or nitrogen gas may be used. Further, in order to increase the discharge efficiency, metal such as mercury or halogen material may be injected.

When electric voltage is applied through a separate connector to the upper electrode 1 and the lower electrode 6 of a neon light utilizing a flat plate electrode, which has been completely manufactured through the process as described above, there is generated an electric potential difference between the two electrodes, so that electric discharge is induced in the discharge space 8. In this case, the phosphor elements 7 in the discharge space 8 are excited by the ultraviolet rays generated by the electric discharge, so as to produce visible rays to thereby enable the desired advertisement pattern to be seen.

The discharge voltage of the electrodes utilizes waves of alternating current such as sine wave, triangular wave, and rectangular wave, and voltage between 100 volts and 10,000 volts. Further, the frequency of the applied voltage may have a range between several tens Hz and several tens MHz.

Figure 6:
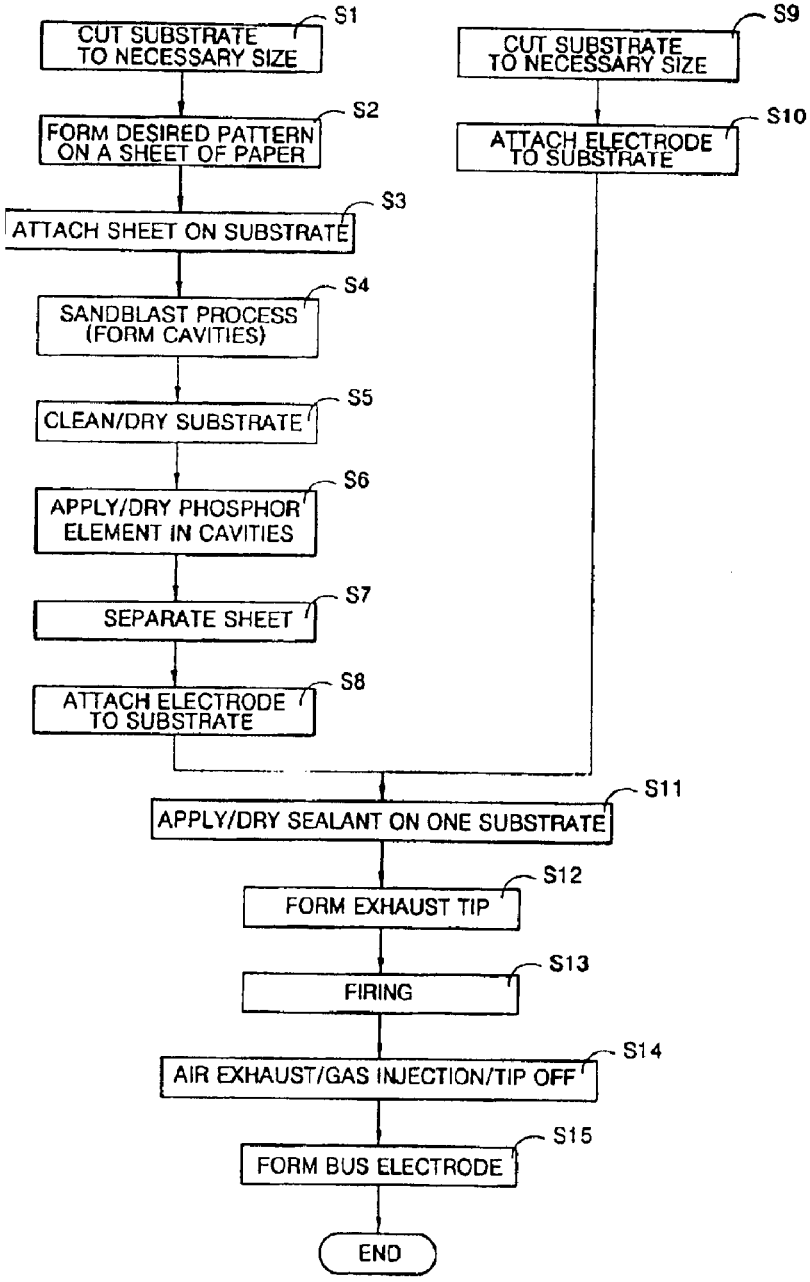
FIG. 6 is a flow chart for showing a process for manufacturing a neon light utilizing a flat plate electrode according to the present invention.

FIG. 6 is a flow chart for showing an entire process for manufacturing a neon light utilizing a flat plate electrode according to the present invention.

First, glass to be used as the lower substrate is cut to a necessary size (S1). Further, a desired pattern is formed on a usual sheet of paper having adhesive applied on one side of the sheet (S2). Thereafter, the sheet of paper, on which the desired pattern is formed in step S2, is attached to a substrate arranged in step S1 (S3). Then, the substrate processed in step S3 is subjected to a sandblast process (S4).

By the sandblast process in the step S4, a portion of the substrate having the sheet attached thereon remains but the other portion of the substrate without the sheet is cut out. As a result, cavities, or discharge spaces, having desired shapes are formed.

Next, in order to eliminate alien materials adhered to the substrate after the sandblast process, the substrate is cleaned and dried (S5). Further, proper phosphor elements are applied to the inner surface of the cavities of the dried substrate, and then the substrate is dried again (S6). Thereafter, the sheet of paper is eliminated (S7), so that a lower substrate having discharge spaces is formed.

After the above process, an electrode is attached to one surface of the lower substrate, on which no cavity is formed (S8). In case where a transparent electrode has already been attached to the substrate, step S8 is not carried out. Otherwise, step S8 may be carried out after the lower substrate is attached to the upper substrate. Further, in the step S8, constructions other than the electrode are provided for the lower substrate. If a protector layer is necessary, it is further formed on the lower substrate.

Meanwhile, the upper substrate also is obtained by cutting glass at a necessary size (S9), and a transparent electrode is attached to the upper substrate (S10). Step S10 has the same characteristics as that of step S8. That is, step S10 includes the step of forming a protector layer on the transparent electrode.

When the upper plate and the lower plate have been fabricated in the process as described above, a sealant is applied on one of the two substrates, which is then dried (S11). Of course, the sealant has to be applied on the lower surface of the upper plate or on the upper surface of the lower plate, a surface on which the cavities are formed.

After step S11 is carried out, an exhaust tip is formed at one side of the lower plate (S12), and a firing of attaching the upper plate and the lower plate with each other is carried out (S13). When the firing in step S13 has been carried out, the upper plate and the lower plate form a neon light sealed from the exterior.

Further, when the exhaust tip is closed after the air is exhausted out of and discharge gas is injected into the discharge spaces by means of the exhaust tip, the interior of the neon light is completely isolated from the exterior (S14). Finally, in order to increase the conductivity of the discharge electrode, a bus electrode is formed, so that all the steps of fabricating the neon light are completed (S15).

Figure 3:
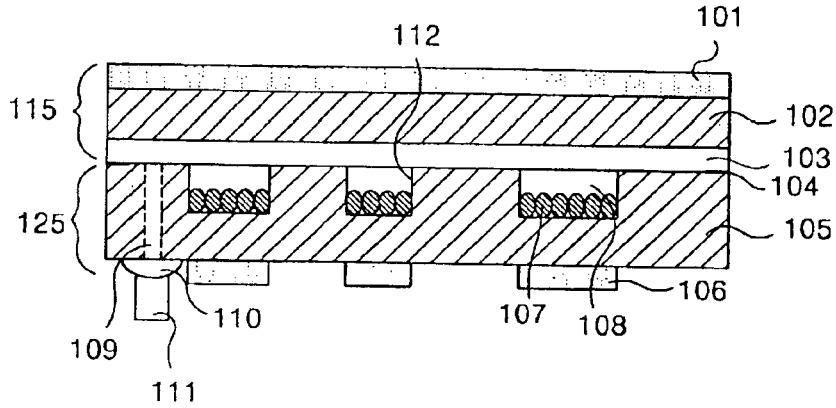
FIG. 3 is a sectional view of a neon light according to the second embodiment of the present invention.

FIG. 3 is a sectional view of a neon light utilizing a flat plate electrode according to the second embodiment of the present invention.

The second embodiment of the present invention has the same characteristics as that of the first embodiment. That is, cavities formed by carving out the lower substrate and surface light sources are the same in both embodiments. Further, constructions of the upper and lower plates have the same characteristics in both embodiments.

However, the second embodiment of the present invention is different from the first embodiment in the aspect of structure. Also, the third and fourth embodiments, which will be described later, are different from the first embodiment only in structure.

In the second embodiment of the present invention, an upper plate 115 has the same construction as that in the first embodiment. However, in a lower plate 125, electrodes 106 are formed only at portions thereof corresponding to cavities 112 or discharge spaces 108, which are so formed as to define a shape equal or similar to the advertisement pattern.

That is, the electrodes 106 correspond to rectangular portions in the present embodiment as shown and are formed on an external portion of the lower substrate 105. Since the pattern in the present embodiment as shown has a shape having separated rectangles of different sizes, the electrodes are formed only on the portions corresponding to the rectangles. Of course, the electrodes are formed entirely over the rectangles.

In this case, the electrodes in total have a shape in which they are separated from each other. Therefore, separate connectors for applying voltage to the electrodes have to be arranged, and the electrodes can be separately operated. For example, when it is necessary to display only one or two predetermined rectangles, the electrodes corresponding to the rectangles can be operated.

Figure 4:
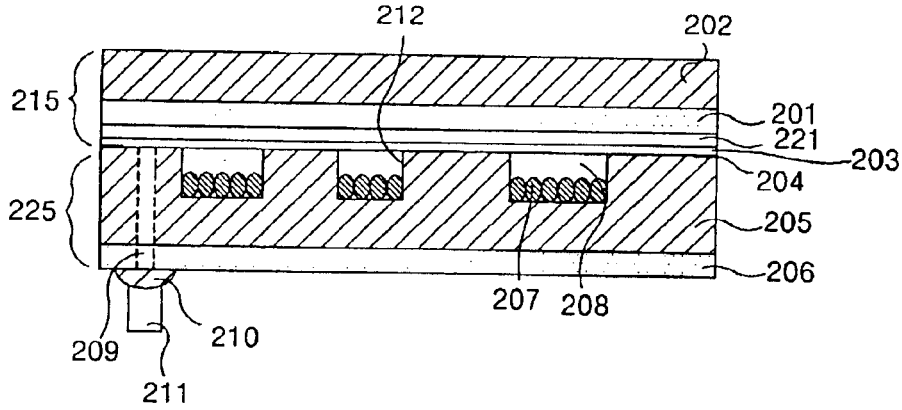
FIG. 4 is a sectional view of a neon light according to the third embodiment of the present invention.

FIG. 4 is a sectional view of a neon light utilizing a flat plate electrode according to the third embodiment of the present invention.

In the present embodiment as shown, a lower plate 225 has the same construction as that in the first embodiment, while an upper plate 215 has a different construction as follows.

An upper substrate 202 is disposed at the uppermost portion of the upper plate 215, and an upper electrode 201 is formed over an entire lower surface of the upper substrate 202. Further, an insulation layer 221 is formed on a lower surface of the upper electrode 201, and a protector layer 203 is formed on a lower surface of the insulation layer 221.

That is, the neon light according to the third embodiment of the present invention has a construction, in which the electrode 201 formed at the upper plate 215 is arranged under the substrate. Also, the neon light of the present embodiment further includes the protector layer 221, in order to insulate the electrode 201.

For example, it is possible to utilize the upper electrode 201 as an ITO transparent electrode and to form the insulation layer 221 made from $SiO_2$ and the like under the electrode. This construction has the effect of decreasing the discharge voltage while increasing the brightness.

Figure 5:
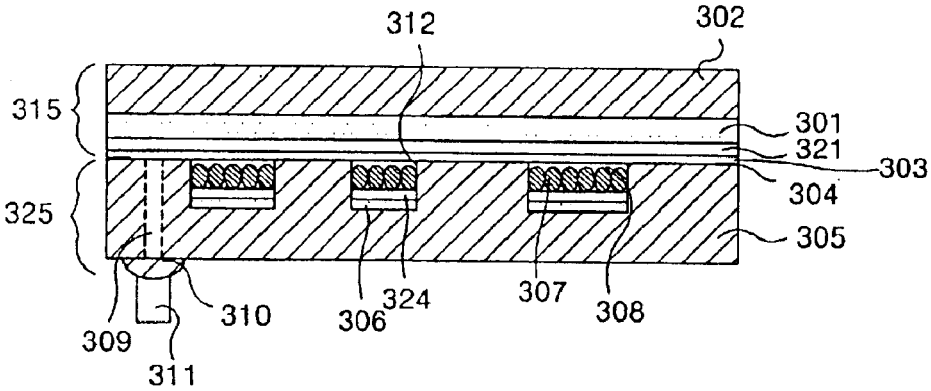
FIG. 5 is a sectional view of a neon light according to the fourth embodiment of the present invention.

FIG. 5 is a sectional view of a neon light utilizing a flat plate electrode according to the fourth embodiment of the present invention.

In the present embodiment as shown, an upper plate 315 has the same construction as that in the third embodiment, while a lower plate 325 has a different construction as follows.

That is, as shown, lower electrodes 306, insulation layers 324, and phosphor elements 307 are formed in discharge spaces 308. The insulation layers 324 are those arranged for insulating the lower electrodes.

Therefore, the lower electrodes 306 are formed on bottom surfaces of cavities, the insulation layers 324 are formed on the lower electrodes, and the phosphor elements 307 are formed on the insulation layers 324.

As described above, in the neon light according to the present invention, an advertisement pattern is expressed by means of discharge spaces formed by carving out one or both of two insulation plates, the upper and lower plates. Therefore, the discharge spaces are integrally formed at the upper plate and/or the lower plate. Further, that the electrodes for the electric discharge, which are formed at the upper and lower electrodes, utilize flat plate electrodes is the basic concept of the present invention.

Further, it goes without saying that various modifications and variations can be made within the spirit and scope of the appended claims by those related to the art.

INDUSTRIAL APPLICABILITY

As can be seen from the foregoing, the neon light utilizing a flat plate electrode according to the present invention can express advertisement patterns having various shapes, which cannot be expressed by the conventional neon light utilizing a linear electrode, in an easy and precise manner, since it utilizes a flat plate electrode. That is, by the neon light of the invention, all designs including fine images can be expressed, and an automation process, which does not require manual labor, can be employed in expressing an image.

Further, in the neon light utilizing a flat plate electrode according to the present invention, since the cavities, or the discharge spaces, for electric discharge are formed by intaglio at the substrate itself, a separate spacer for defining a discharge space is not necessary, and the upper plate and the lower plate can be easily attached to each other.

Moreover, the present invention facilitates mass production of neon lights by means of patterns, and thereby the neon light of the invention is advantageous in terms of manufacturing cost and productivity.

Furthermore, in the neon light of the present invention, since the discharge spaces are formed only by the cavities, the entire volume of the discharge spaces is absolutely small. Also, since light emission or illumination is carried out only in predetermined portions, which are the discharge spaces, the discharge efficiency is relatively high. Therefore, the neon light of the present invention has an effect capable of reducing power consumption by one half or one tenth thereof, in comparison with that of the conventional neon light.

Also, since the neon light according to the present invention has the shape of a picture frame, the neon light can be easily carried and installed. Therefore, it is noted that the present invention provides an additional benefit that it can be beneficial to the circulation of goods.

While this invention has been described in connection with what are presently considered to be the most practical and preferred embodiments, it is to be understood that the invention is not limited to the disclosed embodiments and the drawings, but, on the contrary, it is intended to cover various modifications and variations within the spirit and scope of the appended claims.

What is claimed is:

1. A neon light utilizing a flat plate electrode, the neon light comprising:

a first plate having at least a discharge space and a first flat plate electrode, the discharge space being formed by carving out a first surface of the first plate according to an advertisement pattern, the first flat plate electrode being received in the discharge space so as to generate electric discharge; and a second plate having a second flat plate electrode for inducing the electric discharge, the second plate being tightly attached to the first surface of the first plate, on which the advertisement pattern is formed.

2. A neon light utilizing a flat plate electrode as claimed in claim 1, wherein at least one of the first plate and the second plate is made from transparent material.

3. A neon light utilizing a flat plate electrode as claimed in claim 2, wherein at least one of the first flat plate electrode and the second flat plate electrode is made from transparent material.

4. A neon light utilizing a flat plate electrode as claimed in claim 3, wherein a phosphor element is applied inside of the discharge space.

5. A neon light utilizing a flat plate electrode as claimed in claim 3, wherein a phosphor element is applied on a portion of a surface of the second plate, which corresponds to the discharge space.

6. A neon light utilizing a flat plate electrode as claimed in claim 3, wherein the first flat plate electrode is formed on an external surface of the first plate.

7. A neon light utilizing a flat plate electrode as claimed in claim 3, wherein the first flat plate electrode is formed inside of the discharge space.

8. A neon light utilizing a flat plate electrode as claimed in claim 3, the neon light further comprising an insulation layer formed on the first flat plate electrode.

9. A neon light utilizing a flat plate electrode as claimed in claim 6, wherein the first flat plate electrode is formed correspondingly to an area of the discharge space of the first plate.

10. A neon light utilizing a flat plate electrode as claimed in claim 9, wherein at least one of the first flat plate electrode and the second flat plate electrode is made from indium tin oxide.

11. A neon light utilizing a flat plate electrode as claimed in claim 6, wherein the first flat plate electrode is formed correspondingly to an entire area of the first plate.

12. A neon light utilizing a flat plate electrode as claimed in claim 3, wherein the second flat plate electrode is formed on an external surface of the second plate.

13. A neon light utilizing a flat plate electrode as claimed in claim 12, the neon light further comprising a protector layer formed at a lower surface of the second plate.

14. A neon light utilizing a flat plate electrode as claimed in claim 3, wherein the second flat plate electrode is formed on an internal surface of the second plate.

15. A neon light utilizing a flat plate electrode as claimed in claim 14, the neon light further comprising an insulation layer formed on a lower surface of the second plate.

16. A neon light utilizing a flat plate electrode as claimed in claim 15, the neon light further comprising a protector layer formed on a lower surface of the insulation layer.

17. A neon light utilizing a flat plate electrode as claimed in claim 1, wherein the second plate has a shape equal to a shape of the first plate.

18. A lower plate structure employed in a neon light utilizing a flat plate electrode, the lower plate structure comprising:

a lower glass having at least a discharge space, which is formed by carving out one surface of the lower glass according to an advertisement pattern to be displayed;

a flat plate electrode formed on a first surface and a second surface of the lower glass so as to induce electric discharge, the advertisement pattern being formed on the first surface, the second surface corresponding to the first surface; and at least a phosphor element formed in the discharge space.

19. A lower plate structure employed in a neon light utilizing a flat plate electrode as claimed in claim 18, wherein the flat plate electrode is formed only on a portion corresponding an area of the advertisement pattern.

20. A lower plate structure employed in a neon light utilizing a flat plate electrode as claimed in claim 18, wherein the flat plate electrode is formed on an entire area of the lower glass.

21. A lower plate structure employed in a neon light utilizing a flat plate electrode, the lower plate structure comprising:

a lower glass having at least a discharge space, which is formed by carving out an upper surface of the lower glass according to an advertisement pattern to be displayed;

a flat plate electrode so formed as to induce electric discharge in the discharge space;

an insulation layer formed on the flat plate electrode; and at least a phosphor element formed on the insulation layer.

* * * * *